US008141283B2

(12) United States Patent
Lee et al.

(10) Patent No.: US 8,141,283 B2
(45) Date of Patent: Mar. 27, 2012

(54) ELECTRONIC SHELF LABEL

(75) Inventors: Jae Chan Lee, Gyunggi-Do (KR); Yong Gil Namgung, Gyunggi-Do (KR); Hyun Hak Kim, Gyunggi-Do (KR); Seok Min Woo, Gyunggi-Do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 601 days.

(21) Appl. No.: 12/325,105

(22) Filed: Nov. 28, 2008

(65) Prior Publication Data

US 2010/0031548 A1 Feb. 11, 2010

(30) Foreign Application Priority Data

Aug. 8, 2008 (KR) ..... 10-2008-0077969

(51) Int. Cl.
*G09F 3/18* (2006.01)

(52) U.S. Cl. ..... 40/655; 235/383; 40/657

(58) Field of Classification Search ..... 40/661.03, 40/124.01, 124.05, 5; 235/383; 248/205.2, 248/222.11; 292/127, 327, 336, 70, 87
See application file for complete search history.

(56) References Cited

U.S. PATENT DOCUMENTS

| | | | | |
|---|---|---|---|---|
| 5,461,809 | A | 10/1995 | Fowler et al. | |
| 5,553,412 | A * | 9/1996 | Briechle et al. | 40/124.01 |
| 6,069,596 | A | 5/2000 | Marvin et al. | |
| 7,441,424 | B2 | 10/2008 | Saitoh et al. | |

FOREIGN PATENT DOCUMENTS

| | | | |
|---|---|---|---|
| EP | 0 683 478 | B1 | 9/2000 |
| GB | 2 249 854 | A | 5/1992 |
| JP | 2005099888 | A | 4/2005 |
| KR | 1020070112016 | A | 11/2007 |
| WO | 94/22125 | A2 | 9/1994 |
| WO | 99/03174 | A1 | 1/1999 |

OTHER PUBLICATIONS

Korean Office Action for application No. 10-2008-0077969, issued Mar. 31, 2010.

* cited by examiner

*Primary Examiner* — Joanne Silbermann
*Assistant Examiner* — Shin Kim
(74) *Attorney, Agent, or Firm* — Lowe, Hauptman, Ham & Berner, LLP

(57) ABSTRACT

An electronic shelf label has a simple structure to be easily installed or removed and is attached and detached only through a predetermined-shaped key so as to prevent unauthorized personnel from removing the electronic shelf label, thereby protecting the electronic shelf label from theft.

6 Claims, 9 Drawing Sheets

ELECTRONIC SHELF LABEL

CROSS-REFERENCE TO RELATED APPLICATIONS

This application claims the priority of Korean Patent Application No. 2008-0077969 filed on Aug. 8, 2008 in the Korean Intellectual Property Office, the disclosure of which is incorporated herein by reference.

BACKGROUND OF THE INVENTION

1. Field of the Invention

The present invention relates to an electronic shelf label, and more particularly, to an electronic shelf label configured to perform locking and releasing operations such that the electronic shelf label are attached and detached only through a predetermined-shaped key, so as to prevent theft.

2. Description of the Related Art

Stores including department stores and large discount stores, which sell various products in huge quantities, are provided with numberless display shelves to display and sell various classified products.

A front surface of the display shelves displaying respective products is provided with a display device having the name and the price of a relevant product, so that consumers can purchase desired products.

However, as the size of stores gradually increases, the kinds and the number of products requiring management also increase. Thus, it is actually difficult for a manager to manually and directly manage the prices of all products, as in the related art.

To address these limitations, methods are being actively researched of managing information about various products through electronic control devices with electronic shelf labels (ESLs) and transmitting the information to electronic labels displaying the relevant products through a wireless communication manner.

Since such electronic shelf labels are managed together by a system for integrally managing the electronic shelf labels, it is very easy to manage various products, but it is difficult to protect the electronic shelf labels, that are electronic devices, from theft or loss.

Also, to protect the electronic shelf labels from theft, the electronic shelf labels are required to be firmly fixed to display shelves. In this case, it is difficult to install or remove the electronic shelf labels from the display shelves.

SUMMARY OF THE INVENTION

An aspect of the present invention provides an electronic shelf label that has a simple structure to be easily installed or removed and that is attached and detached only through a predetermined-shaped key so as to prevent unauthorized personnel from removing the electronic shelf label, thereby protecting the electronic shelf label from theft.

According to an aspect of the present invention, there is provided an electronic shelf label including: a case part having a predetermined-sized inner space and including an upper case and a lower case that are removably attached to each other; a display part disposed in the case part and displaying information about a product; and a locking device part disposed in the case part and performing catching and releasing operations only through a predetermined key to attach and detach the case part from a rail of a shelf.

The electronic shelf label may further include a data-receiving part disposed in the case part, and the data-receiving part may receive product information transmitted from an outside and transmit the product information to the display part.

The data-receiving part may include a data-transmitting part transmitting information about a product to a central processing unit.

The case part may include a guide part, and the guide part may support and guide the locking device part to move in a straight line in a predetermined direction.

The locking device part may move in a straight line direction along a predetermined path in the case part through the key and perform the catching and releasing operations.

The locking device part may include: a first catch part including: one or more first protruding parts in contact with the key, along a first body part; and a first catch protrusion integrally provided through a first elastic part in an upper portion of the first body part, the first catch protrusion being caught and fixed to a rack of the shelf; and a second catch part including: one or more second protruding parts in contact with the key, along a second body part; and a second catch protrusion integrally provided through a second elastic part in an upper portion of the second body part, the second catch protrusion being caught and fixed to the rack of the shelf.

The first catch protrusion may include a receiving recess therein such that the second catch protrusion is movably coupled to the receiving recess.

Positions, where the first protruding parts are disposed along the first body part, may be substantially the same as positions where the second protruding parts are disposed along the second body part.

Positions, where the first protruding parts are disposed along the first body part, may be substantially different from positions where the second protruding parts are disposed along the second body part.

The first catch part and the second catch part may be adapted such that when the key moves the first body part and the second body part backward, the first catch protrusion and the second catch protrusion are stored into the case part, and the first catch part and the second catch part may be adapted such that when restoring forces of the first elastic part and the second elastic part move the first body part and the second body part forward, the first catch protrusion and the second catch protrusion are exposed out of a side surface of the case part.

The first catch part and the second catch part may further include a third elastic part to generate a restoring force for moving forward the first catch part and the second catch part, that have been moved backward by the key, to original positions of the first catch part and the second catch part.

The display part may include an electronic display device including a liquid crystal display (LCD).

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
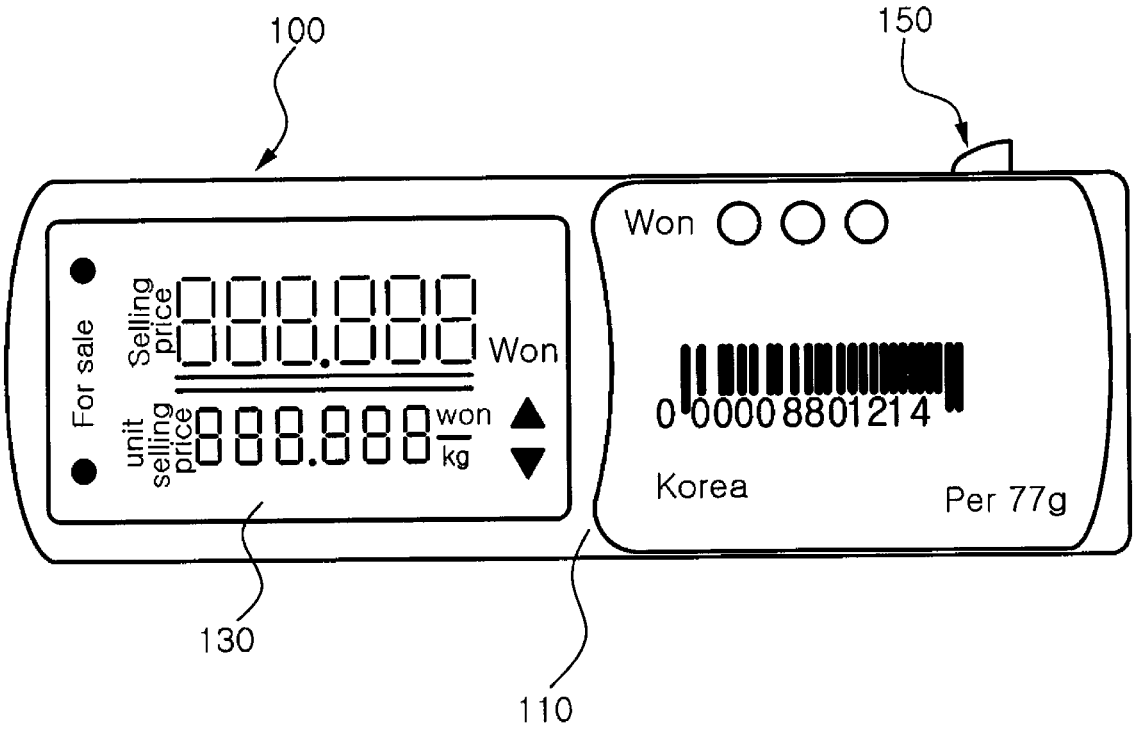
FIG. 1 is a front view illustrating an electronic shelf label according to an embodiment of the present invention.
Figure 2:
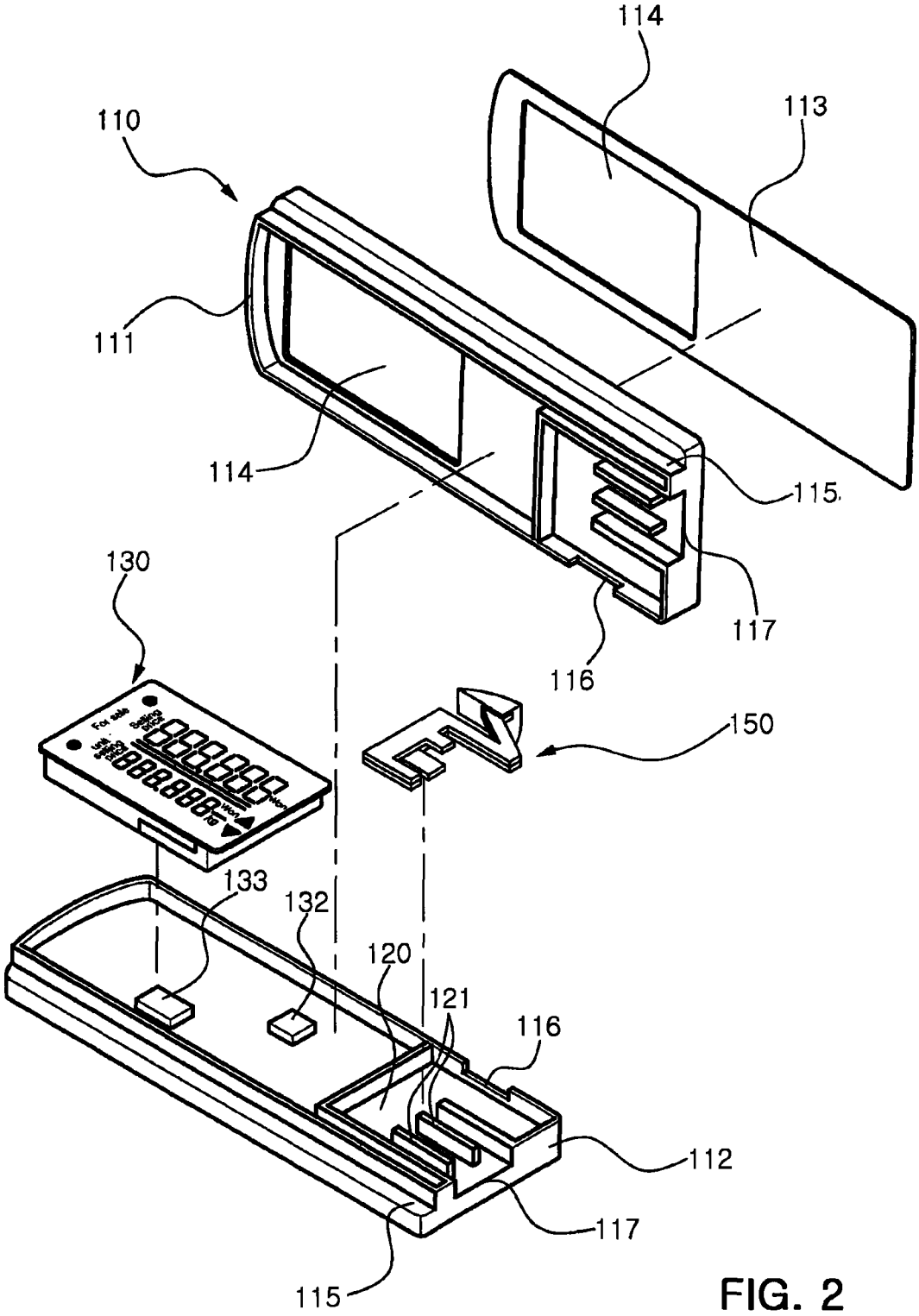
FIG. 2 is an exploded perspective view schematically illustrating the electronic shelf label illustrated in FIG. 1.

Referring to FIGS. 1 and 2, an electronic shelf label 100 according to one embodiment of the present invention will now be described.

FIG. 1 is a front view illustrating the electronic shelf label 100 according to the embodiment of the present invention. FIG. 2 is an exploded perspective view schematically illustrating the electronic shelf label 100 illustrated in FIG. 1.

Referring to FIGS. 1 and 2, the electronic shelf label 100 includes a case part 110, a display part 130, and a locking device part 150.

The case part 110 is a hollow member including an inner space having a predetermined size to receive the display part 130 and the locking device part 150.

As illustrated in FIG. 2, the case part 110 includes an upper case 111 and a lower case 112 that are removably coupled to each other.

The upper case 111 and the lower case 112 may be closely coupled to each other through an adhesive (not shown) applied along an interface thereof. Alternatively, screw holes (not shown) may be respectively provided to the upper case 111 and the lower case 112 to couple the upper case 111 to the lower case 112 using a screw member (not shown).

A hole 114 passes through the upper case 111, and the area of the hole 114 is approximately half the area of a front surface part of the upper case 111. Thus, a front surface of the display part 130 provided in the case part 110 is exposed to the outside.

As illustrated in FIG. 2, the hole 114, provided to the upper case 111, may have a tetragonal shape to correspond to the shape of the display part 130, but is not limited thereto, and there may be various shape.

Also, the hole 114 leans toward a side of the upper case 111 having a rectangular structure, but is not limited thereto. For example, the hole 114 may be disposed at a center of the upper case 111.

The upper case 111 and the lower case 112 respectively include openings 116 having a predetermined size, and the openings 116 are respectively disposed at upper surfaces in a longitudinal direction of the upper case 111 and the lower case 112. Thus, the locking device part 150, that will be described later, performs catching and releasing operations through the openings 116.

Also, the upper case 111 and the lower case 112 respectively include catch recesses 115 having a stair structure in lower surfaces thereof in the longitudinal direction, so as to be fitted onto a rail 163 of a rack 161, thereby preventing the upper case 111 and the lower case 112 from being removed.

Also, the upper case 111 and the lower case 112 respectively include key holes 117 having a predetermined size in side surfaces thereof, such that a key 10 having a predetermined shape, for operating the locking device part 150, is inserted into the key holes 117.

In addition, the upper case 111 and the lower case 112 include guide parts 120 connected to the key holes 117 so as to dispose and support the locking device part 150 in the case part 110, and to guide the locking device part 150 to move in a straight line toward a predetermined direction.

The upper surface of the upper case 111 may be coupled with a cover member 113 to protect the display part 130 and the upper case 111 exposed to a front surface when the case part 110 is mounted to the rack 161 of a shelf.

The shape of the cover member 113 corresponds to the shape of the front surface part of the upper case 111, and the position of the hole 114 corresponds to the position of the display part 130.

The cover member 113 may be removably coupled to the upper case 111, and formed of a transparent plastic resin to be easily identified from the outside.

Also, a card, including the name of a product and information of a bar code, is attached to a surface of the cover member 113 or is inserted between the cover member 113 and the upper case 111, thereby easily finding a desired product or distinguishing a desired product from other products.

The display part 130 is fixed to the inside of the case part 110, and is an electronic member displaying information of a relevant product in real time.

Such information may include price information such as a sale price, a discount price, and a unit cost of a product, and various data such as inventory volume, weight, the date of production (manufacture), and an ambient temperature.

The display part 130 may be an electronic display device including a liquid crystal display (LCD).

Also, a data-receiving part 132 may be configured to receive information of a product transmitted from a central processing unit (not shown) and transmit the information to the display part 130. The central processing unit is connected to the electronic shelf label 100, provided in plurality, through a wired or wireless network to integrally control the electronic shelf labels 100.

The data-receiving part 132 is separately provided in the case part 110 and is electrically connected to the display part 130, or is integrally provided in the display part 130.

The data-receiving part 132 is connected in a RF communication manner to an antenna (not shown) installed in a store so as to receive data transmitted from the central processing unit.

Also, the data-receiving part 132 may include a data-transmitting part 133 to transmit information about a product to the central processing unit, thereby controlling a change in the product and detecting the position of the product in a store.

The display part 130 may further include a temperature sensor, that is not shown, so as to sense an ambient temperature of a product requiring refrigerating or freezing and to display the ambient temperature, thereby checking storage condition of the product.

The locking device part 150 is provided in the case part 110, and performs the catching and releasing operations only through the predetermined shaped key 10 such that the case part 110 is removably attached to the rack 161 of the shelf.

The configuration of the locking device part 150 illustrated in FIG. 2 will now be described in more detail with reference to FIGS. 3 to 5.

Figure 3A:
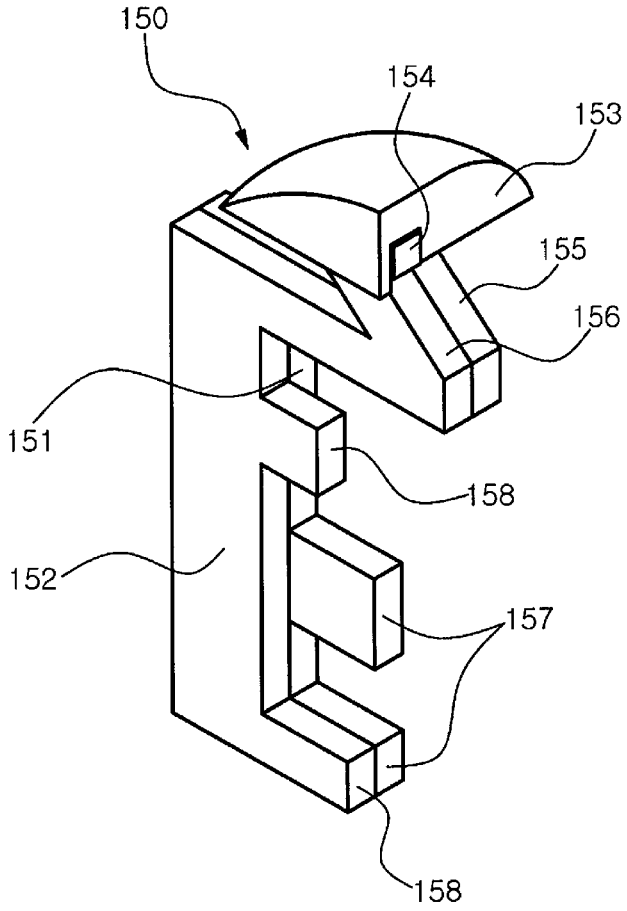
FIGS. 3A and 3B are a perspective view and a side view that illustrate a locking device part in the electronic shelf label illustrated in FIG. 2.
Figure 3B:
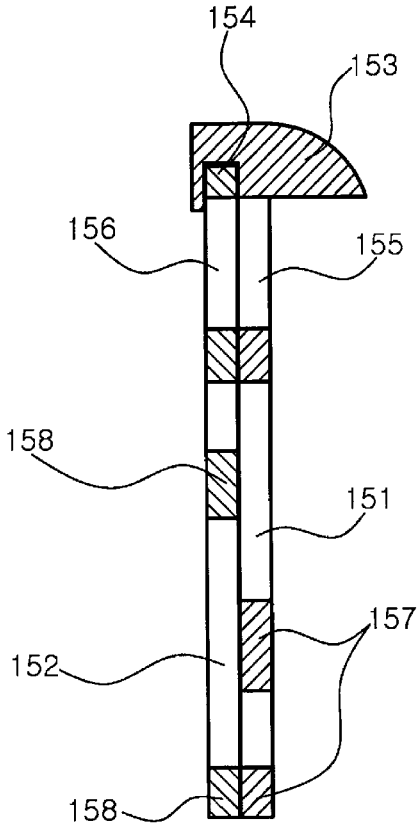
Figure 4A:
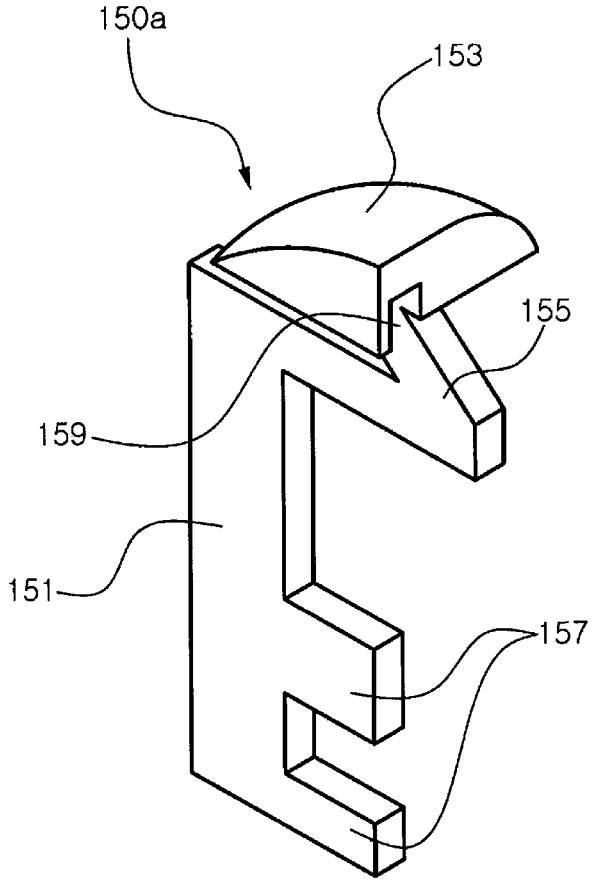
FIGS. 4A and 4B are a perspective view and a side view that illustrate a first catch part in the locking device part illustrated in FIGS. 3A and 3B.
Figure 4B:
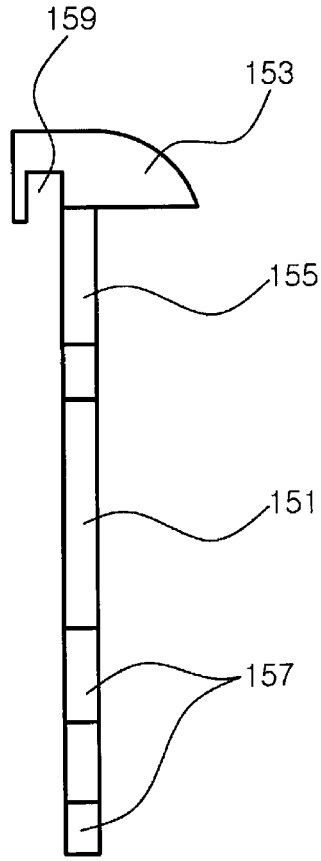
Figure 5A:
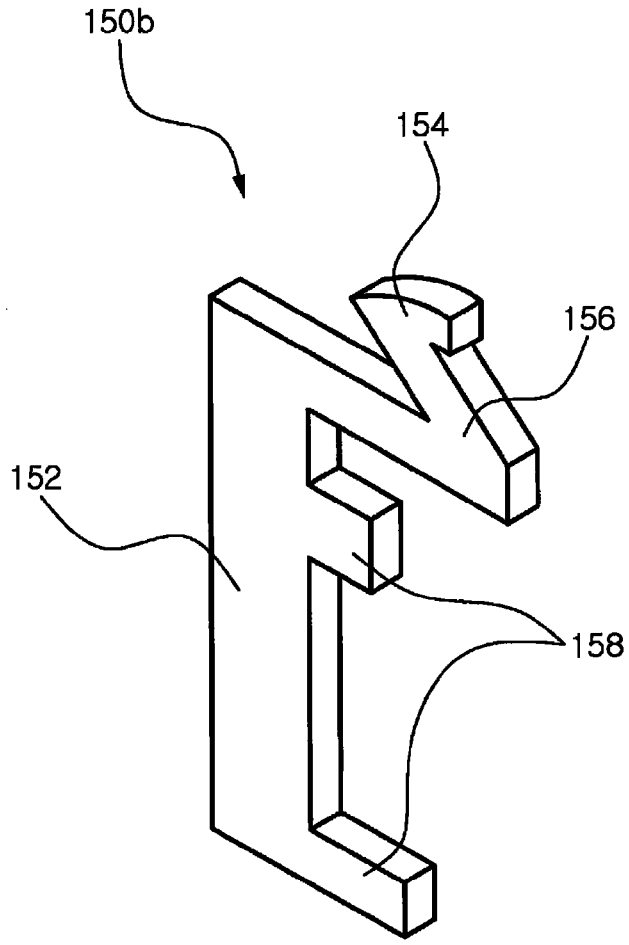
FIGS. 5A and 5B are a perspective view and a side view that illustrate a second catch part in the locking device part illustrated in FIGS. 3A and 3B.
Figure 5B:
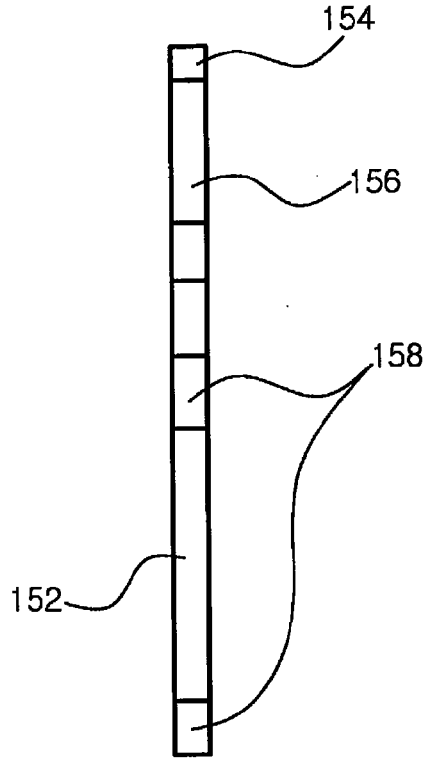

FIGS. 3A and 3B are a perspective view and a side view that illustrate the locking device part 150 in the electronic shelf label 100 illustrated in FIG. 2. FIGS. 4A and 4B are a perspective view and a side view that illustrate a first catch part 150*a* in the locking device part 150 illustrated in FIGS. 3A and 3B. FIGS. 5A and 5B are a perspective view and a side view that illustrate a second catch part 150*b* in the locking device part 150 illustrated in FIGS. 3A and 3B.

Referring to FIGS. 3A and 3B, the locking device part 150 of the electronic shelf label 100 according to the embodiment of the present invention includes the first catch part 150*a* and the second catch part 150*b*.

Referring to FIGS. 4A and 4B, the first catch part 150*a* includes one or more first protruding parts 157 in contact with the key 10 along a first body part 151, and an upper portion of the first body part 151 is integrally formed through a first elastic part 155 with a first catch protrusion 153 caught and fixed by the rack 161.

The first body part 151, the first protruding parts 157, and the first elastic part 155 are provided in a thin plate shape having a predetermined thickness. The first catch protrusion 153 has a shape corresponding to one-eighth of a sphere, which has a curved surface of the sphere and cross sections from the sphere.

The first catch part 150*a* may be integrally formed through injection molding.

Referring to FIGS. 5A and 5B, the second catch part 150*b* includes one or more second protruding parts 158 in contact with the key 10 along a second body part 152, and an upper portion of the second body part 152 is integrally formed through a second elastic part 156 with a second catch protrusion 154 caught and fixed by the rack 161.

Like the first catch part 150*a*, the second catch part 150*b* has a thin plate shape as a whole, and the second body part 152, the second protruding parts 158, and the second elastic part 156 are substantially configured in the same manner as that of the first catch part 150*a*.

However, the second catch protrusion 154 is configured to correspond to the cross section of the first catch protrusion 153, and has a plate shape smaller than the first catch protrusion 153.

Thus, the second catch protrusion 154 is movably coupled to a receiving recess 159 disposed in the first catch protrusion 153, as illustrated in FIGS. 3A and 3B.

Positions, where the first protruding parts 157 and the second protruding parts 158 are respectively disposed, may be partially the same as each other, but may be partially different from each other. That is, when the first catch part 150*a* and the second catch part 150*b* are coupled to each other as illustrated in FIGS. 3A and 3B, the first protruding parts 157 and the second protruding parts 158 partially overlap each other, but partially do not overlap each other.

However, the present invention is not limited thereto. For example, the positions, where the first protruding parts 157 and the second protruding parts 158 are respectively disposed at the first body part 151 and the second body part 152, may be substantially different from each other as a whole, or the positions, where the first protruding parts 157 and the second protruding parts 158 are respectively disposed, may be substantially the same from each other as a whole such that the first protruding parts 157 and the second protruding parts 158 entirely overlap each other.

In addition, respective protruding lengths and respective protruding heights of the first protruding parts 157 and the second protruding parts 158 may be varied.

As such, the locking device part 150 according to the present invention includes the first catch part 150*a* and the second catch part 150*b* that are coupled to each other, moves in a straight line direction along a predetermined path in the case part 110 through the predetermined shaped key 10, and performs the catching and releasing operations.

The releasing operation is performed only when the first catch part 150*a* and the second catch part 150*b* are simultaneously and integrally moved backward.

That is, since the first catch part 150*a* and the second catch part 150*b* form a double structure, movement of any one of the first catch part 150*a* and the second catch part 150*b* is not enough to perform the releasing operation. Thus, only when the first catch part 150*a* and the second catch part 150*b* are simultaneously moved, the releasing operation is performed.

Figure 6:
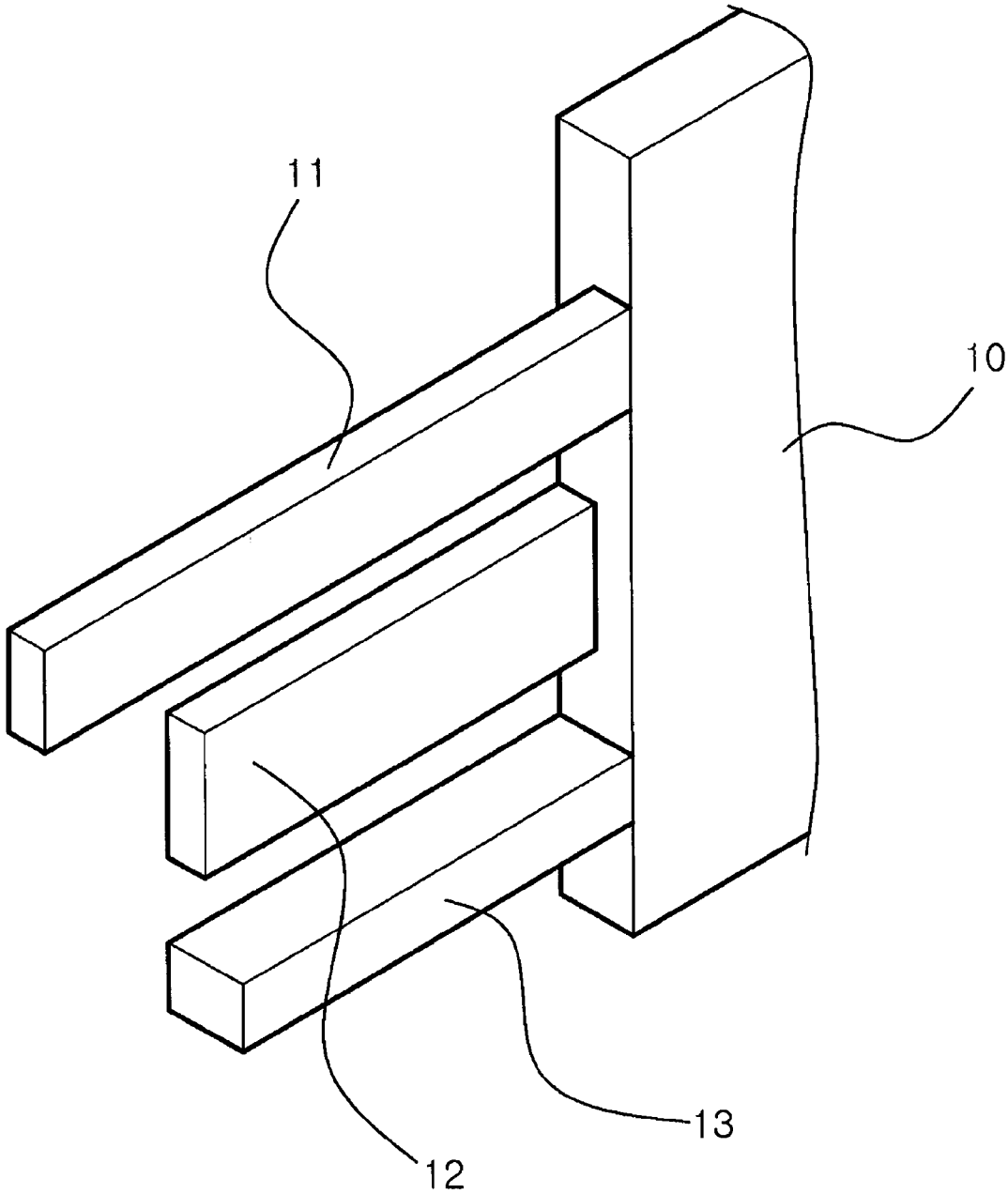
FIG. 6 is a perspective view illustrating a key operating the locking device part illustrated in FIGS. 3A and 3B.

Referring to FIG. 6, the predetermined shaped key 10 for operating the locking device part 150 will now be described.

FIG. 6 is a perspective view illustrating the key 10 for operating the locking device part 150 illustrated in FIGS. 3A and 3B.

As illustrated in FIG. 6, the key 10 includes a plurality of rods 11, 12, and 13. The rods 11, 12, and 13 respectively correspond to the first protruding parts 157 and the second protruding parts 158 and come in contact with the first protruding parts 157 and the second protruding parts 158 to simultaneously move the first catch part 150*a* and the second catch part 150*b* backward.

The rods 11, 12, and 13 are configured to correspond to the structure of the first protruding parts 157 and the second protruding parts 158 having various lengths, heights, thicknesses. Thus, the first catch part 150*a* and the second catch part 150*b* do not individually move, but move together all the time.

Referring to FIGS. 7 and 8, the catching and releasing operations through the locking device part 150 of the electronic shelf label 100 according to the present invention will now be described.

FIGS. 7A to 7D are sequential schematic views illustrating a process of fixing the electronic shelf label 100 illustrated in FIG. 1 to the rack 161 of the shelf. FIGS. 8A and 8B are cross-sectional views illustrating a manner of releasing the locking device part 150 illustrated in FIGS. 3A and 3B.

Figure 7A:
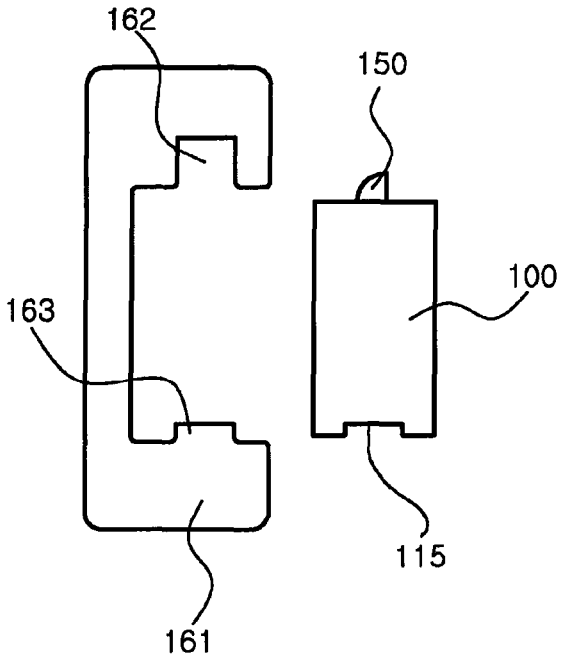
FIGS. 7A to 7D are sequential schematic views illustrating a process of fixing the electronic shelf label illustrated in FIG. 1 to a rack of a shelf.
Figure 8A:
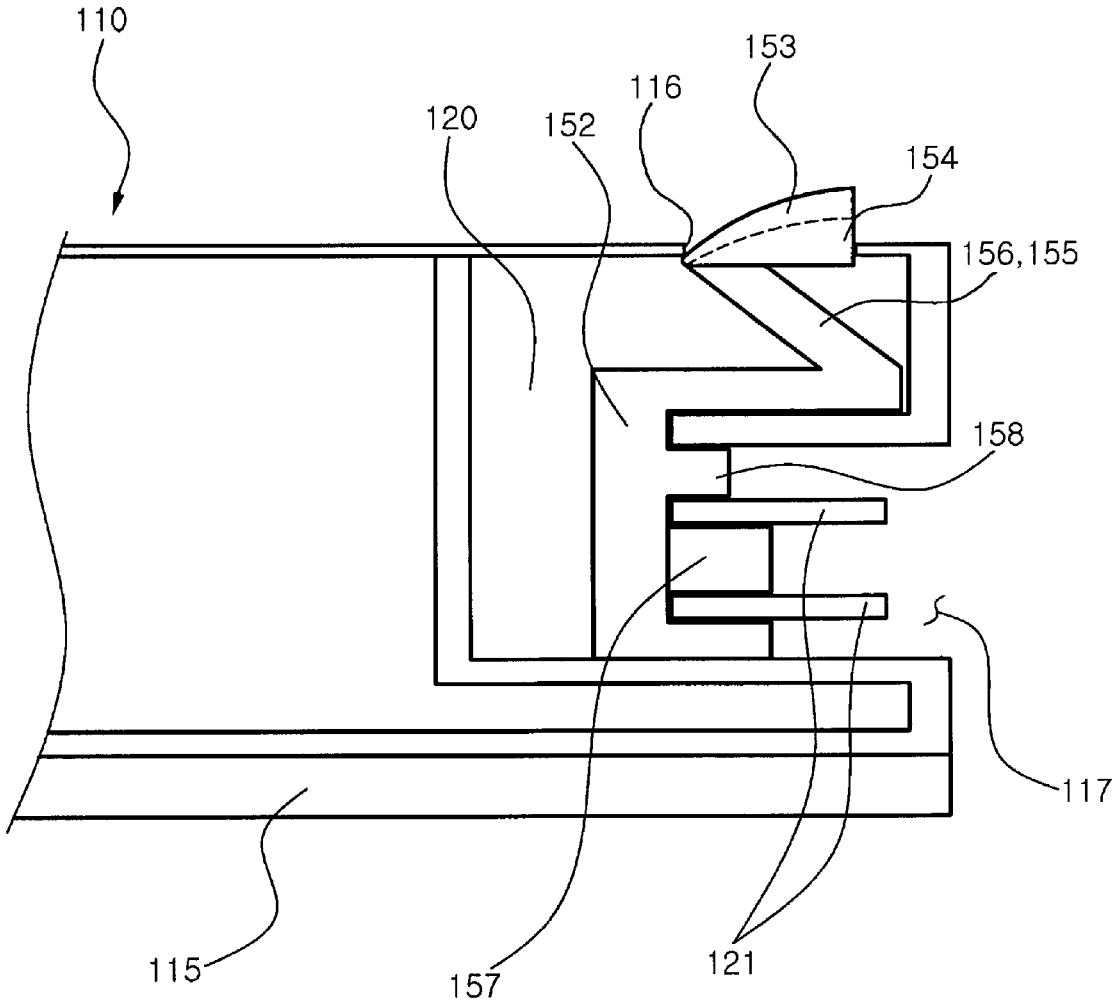
FIGS. 8A and 8B are cross-sectional views illustrating a manner of releasing the locking device part illustrated in FIGS. 3A and 3B.
Figure 8B:
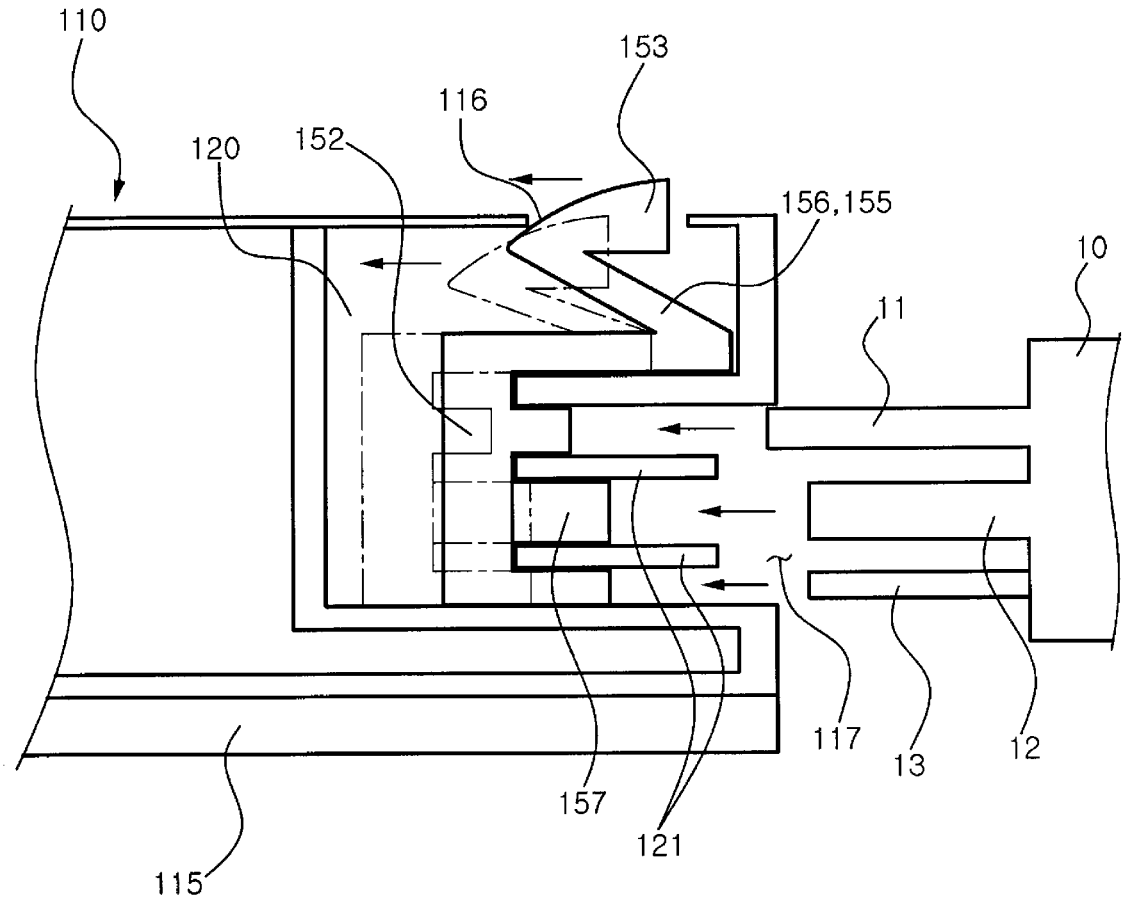

Referring to FIGS. 7A, the rack 161 of the shelf disposed in a store includes a coupling recess 162 in an inner upper surface thereof, and the coupling recess 162 catches and fixes the locking device part 150 according to the present invention.

The electronic shelf label 100 according to the present invention is configured to be mounted to the rack 161 of the shelf.

Figure 7B:
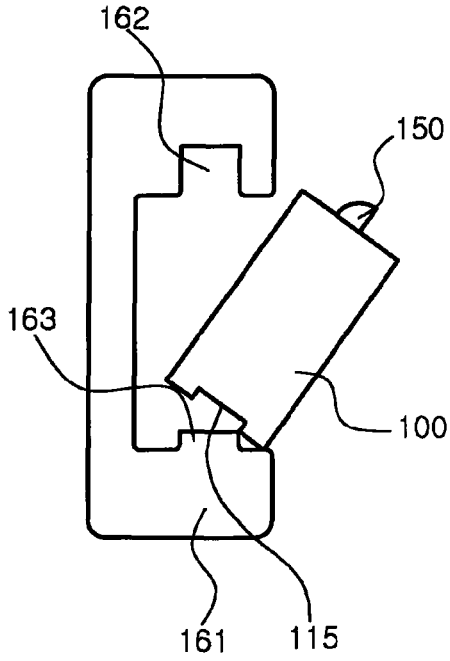
Figure 7C:
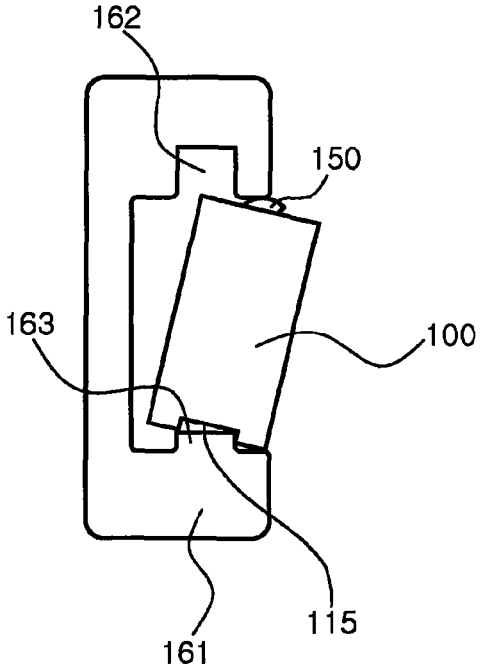

First, referring to FIG. 7B, the electronic shelf label 100 is slantly inserted to the rack 161 such that the catch recesses 115 disposed on a lower side of the electronic shelf label 100 are fitted on the rail 163. Then, referring to FIG. 7C, when a force is applied to insert an upper side of the electronic shelf label 100, the first catch protrusion 153 and the second catch protrusion 154 of the locking device part 150 are compressed by the rack 161 and pushed into the case part 110.

Figure 7D:
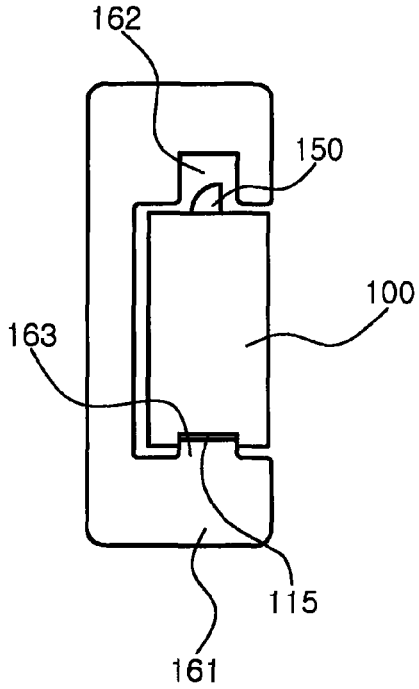

Then, referring to FIG. 7D, the first catch protrusion 153 and the second catch protrusion 154 are restored to their original position by the elasticity of the first elastic part 155 and the second elastic part 156 and are caught and fixed in the coupling recess 162, so that the electronic shelf label 100 is mounted to the rack 161.

As described above, the catch recesses 115 and the coupling recess 162 respectively catch and fix the rail 163 and the first and second catch protrusions 153 and 154 of the electronic shelf label 100 mounted to the rack 161, so that the electronic shelf label 100 is not easily removed from the rack 161, but is removed only through the predetermined shaped key 10 as illustrated in FIG. 6.

Referring to FIGS. 8A and 8B, the manner of releasing the locking device part 150 through the key 10 will now be described.

As illustrated in FIG. 8A, the locking device part 150 disposed and supported in the guide parts 120 provided in the case part 110, and the first catch protrusion 153 and the second catch protrusion 154 protrude through the openings 116 to the outside of the case part 110 and exposed to be caught and fixed to the coupling recess 162 of the rack 161.

Guides 121 connected to the key holes 117 are respectively disposed between the first protruding parts 157 and the second protruding parts 158 so as to guide the locking device part 150 to reciprocate in a predetermined direction.

To remove the electronic shelf label 100 from the rack 161, the first catch protrusion 153 and the second catch protrusion 154 are released from the coupling recess 162, which requires the key 10.

As illustrated in FIG. 8B, the rods 11, 12, and 13 come in contact with the first protruding parts 157 and the second protruding parts 158 such that the key 10 inserted through the key holes 117 simultaneously move the first catch part 150*a* and the second catch part 150*b* backward.

At this point, the first catch protrusion 153 and the second catch protrusion 154 move with an upper curved surface coming in contact with the openings 116, so as to be compressed by the openings 116.

Pressure between the openings 116 and the first and second catch protrusions 153 and 154 is applied in a perpendicular direction to a moving direction of the locking device part 150, so that the first catch protrusion 153 and the second catch protrusion 154 are inserted into the case part 110, and thus, the locking device part 150 is released.

When the key 10 is removed, restoring forces of the compressed the first and second elastic parts 155 and 156 move the first catch part 150*a* and the second catch part 150*b* forward, the locking device part 150 returns to its original position, and the first catch protrusion 153 and the second catch protrusion 154 are exposed again through the openings 116 to the outside.

The first catch part 150*a* and the second catch part 150*b* further includes a third elastic part, that is not shown, between the first and second body parts 151 and 152 and the guide parts 120, to generate a restoring force for moving forward the first catch part 150*a* and the second catch part 150*b*, that are moved backward by the key 10, to their original positions.

The third elastic part includes at least one coil spring, or may include a leaf spring.

The electronic shelf label according to the present invention has a simple structure to be easily installed or removed and that is attached and detached only through the predetermined shaped key so as to prevent unauthorized personnel from removing the electronic shelf label, thereby protecting the electronic shelf label from theft.

While the present invention has been shown and described in connection with the exemplary embodiments, it will be apparent to those skilled in the art that modifications and variations can be made without departing from the spirit and scope of the invention as defined by the appended claims.

What is claimed is:

1. An electronic shelf label comprising:

a case part having a predetermined-sized inner space and comprising an upper case and a lower case that are removably attached to each other;

a display part disposed in the case part and displaying information about a product; and a locking device part disposed in the case part and performing catching and releasing operations only through a predetermined key to attach and detach the case part from a rail of a shelf, wherein the locking device part comprises:

a first catch part comprising: one or more first protruding parts in contact with the key, along a first body part; and a first catch protrusion integrally provided through a first elastic part in an upper portion of the first body part, the first catch protrusion being caught and fixed to a rack of the shelf; and a second catch part comprising: one or more second protruding parts in contact with the key, along a second body part; and a second catch protrusion integrally provided through a second elastic part in an upper portion of the second body part, the second catch protrusion being caught and fixed to the rack of the shelf.

2. The electronic shelf label of claim 1, wherein the first catch protrusion comprises a receiving recess therein such that the second catch protrusion is movably coupled to the receiving recess.

3. The electronic shelf label of claim 1, wherein positions, where the first protruding parts are disposed along the first body part, are substantially the same as positions where the second protruding parts are disposed along the second body part.

4. The electronic shelf label of claim 1, wherein positions, where the first protruding parts are disposed along the first body part, are substantially different from positions where the second protruding parts are disposed along the second body part.

5. The electronic shelf label of claim 1, wherein the first catch part and the second catch part are adapted such that when the key moves the first body part and the second body part backward, the first catch protrusion and the second catch protrusion are stored into the case part, and the first catch part and the second catch part are adapted such that when restoring forces of the first elastic part and the second elastic part move the first body part and the second body part forward, the first catch protrusion and the second catch protrusion are exposed out of a side surface of the case part.

6. The electronic shelf label of claim 5, wherein the first catch part and the second catch part further comprise a third elastic part to generate a restoring force for moving forward the first catch part and the second catch part, that have been moved backward by the key, to original positions of the first catch part and the second catch part.

* * * * *